US005145459A

United States Patent [19]

Meline et al.

[11] Patent Number: 5,145,459

[45] Date of Patent: Sep. 8, 1992

[54] PROCESS AND APPARATUS FOR THE DYNAMIC SEPARATION OF TWO ZONES

[75] Inventors: François Meline, Paris; Robert Guetron, Antony, both of France

[73] Assignee: SGN-SocieteGeneral Pour Les Techniques Nouvelles, Le Bretonneux, France

[21] Appl. No.: 668,019

[22] Filed: Mar. 12, 1991

[30] Foreign Application Priority Data

Mar. 14, 1990 [FR] France ..... 90 03255

[51] Int. Cl.[5] ..... F24F 9/00

[52] U.S. Cl. ..... 454/190; 454/57; 454/191

[58] Field of Search ..... 98/36, 115.3; 454/190

[56] References Cited

U.S. PATENT DOCUMENTS 2,593,702 4/1952 Schneible ..... 98/36 X
3,211,078 10/1965 Asker ..... 98/36
4,576,613 3/1986 Miline ..... 454/56

FOREIGN PATENT DOCUMENTS 99818 2/1984 European Pat. Off. ..... 98/36
1237694 6/1971 United Kingdom ..... 98/36

*Primary Examiner*—Harold Joyce
*Attorney, Agent, or Firm*—Pearne, Gordon, McCoy & Granger

[57] ABSTRACT

In order to ensure a bidirectional dynamic separtion between two zones (10,12), between said zones is formed a gas curtain constituted by three juxtaposed gas streams or jets (28,30,32). The central stream or jet is relatively fast and serves to stabilize the two relatively slow lateral streams or jets (30,32). The latter ensure the relative confinement of the two zones by means of their tongues (30a,32a) and their flow rate is determined in such a way as to supply the relatively fast stream with the gas necessary for its full development. In the case where one (10) of the zones has a reduced volume, a low flow rate, additional gas flow can be injected into the said zone.

4 Claims, 1 Drawing Sheet

PROCESS AND APPARATUS FOR THE DYNAMIC SEPARATION OF TWO ZONES

DESCRIPTION

Figure 1:
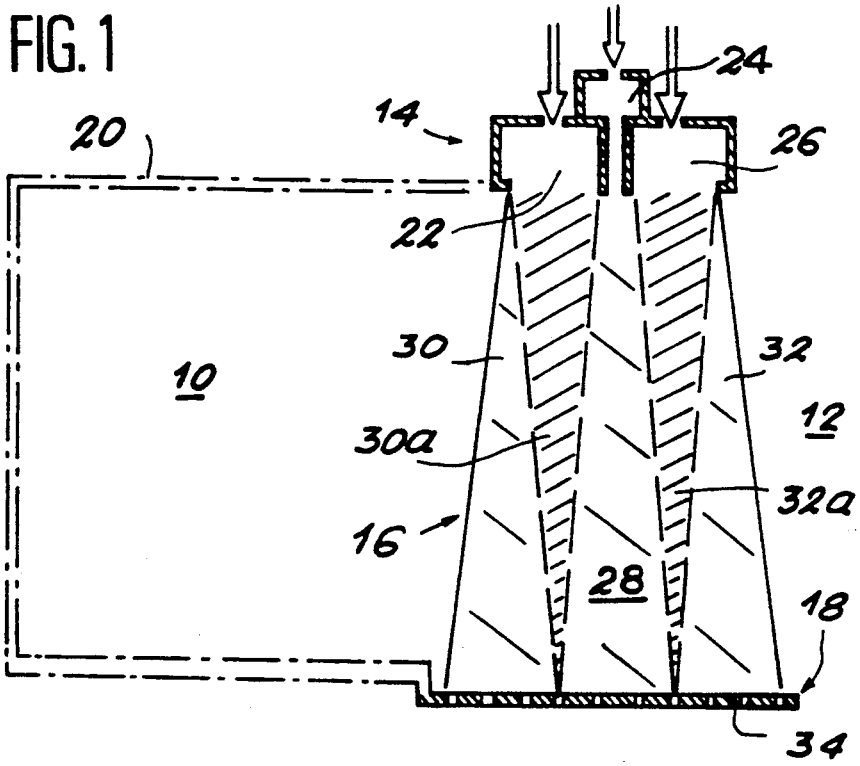

The present invention relates to a process making it possible to ensure the dynamic separation of two zones, one of the said zones being under a controlled atmosphere, whose confinement with respect to the external atmosphere must be preserved. The invention also relates to an apparatus for performing the process.

In industrial fields as different as the nuclear industry, medicine, biology and the electronic and agro-alimentary industries, it is often necessary to isolate certain zones from the external atmosphere, either to protect persons outside the zones from a toxic or dangerous confined atmosphere, or to prevent a confined atmosphere from being polluted by the surrounding atmosphere, or for simultaneously fulfilling both these functions.

In most cases, these constraints lead to the definition of zones under a controlled atmosphere by tight walls ensuring the desired confinement. However, no matter which industrial field is involved, operators may have to work within the controlled atmosphere zone, through the confinement barrier, whilst having a certain freedom of movement. For this reason, it is necessary in certain cases to at least partly replace the solid wall defining the zone under a controlled atmosphere by a dynamic barrier preserving the confinement of the zone in question, whilst still allowing easier interventions through the dynamic barrier.

As is more particularly illustrated by EP-A-99 818, it has been proposed to protect the external atmosphere from a confined zone accessible by an opening and containing dangerous products which might pollute the external atmosphere, by creating in the said opening a gas curtain having a relatively fast stream or vein located on the side of the external atmosphere to be protected and a relatively slow stream or vein adjacent to the first-mentioned and located on the side of the zone containing the dangerous products.

In said document, in order that the dynamic separation of the two zones is effective, the tongue of the relatively slow stream, i.e. the zone of said stream in which the injected gas does not mix with the surrounding atmosphere and has a vector velocity equal at all points, has a length at least equal to the length of the opening, so that in itself said tongue completely separates the two zones. Moreover, the injection rate of the gas into the relatively slow stream is substantially equal to the rate induced by the face of the relatively fast stream and which is in contact with the relatively slow stream, so that the relatively fast stream can completely develop without its path being inflected from one side or the other.

In the thus formed gas curtain, the relatively slow stream ensures the effective separation between the two zones as a result of its tongue and the relatively fast stream stabilizes the relatively slow stream by constituting a "dynamic tutor" for it.

These characteristics make it possible to avoid any passage of polluted atmosphere from the confined zone into the external atmosphere, because any displacement of air or gas in this direction meets the tongue of the relatively slow stream, which then bears on the relatively fast stream. However, this dynamic confinement still allows multiple interventions at all points of the gas barrier.

However, the thus created dynamic barrier is not effective in the other direction. Thus, a flow of air or gas from the external atmosphere and oriented towards the confined zone may inwardly curve the tongue of the relatively slow stream towards the latter zone, thereby breaking the confinement.

Moreover and in known manner a moving gas stream creates on either side of its path a vacuum, which rises with the velocity of the gas. This vacuum sucks in the surrounding gas and leads to a progressive widening of the stream during its advance. This widening obviously presupposes that gas in an adequate quantity is present on either side of the relatively fast stream. In the opposite case, the stream will tend to inflect from the side where the gas supply is inadequate.

In the case of the gas curtain described in EP-A-99 818, the relatively fast stream is supplied on one side by the relatively slow stream and on the opposite side by the external atmosphere.

However, if the apparatus is used in the opposite direction (i.e. with the relatively fast stream on the side of the confined zone), in order to protect the atmosphere contained in the confined zone from the external atmosphere, it is necessary to provide means for supplying gas to the relatively fast stream from the side of said confined zone.

Therefore, in the latter case, it is necessary to inject a gas under a relatively high flow rate into the zone under a controlled atmosphere. When the said gas is an inert gas, this leads to a high consumption, which is highly prejudicial to the operating costs of the installation.

Moreover, it is often desirable to have an effective dynamic barrier in both directions between the two zones, e.g. in order to protect the exterior from the pollution in the confined zone, whilst still maintaining the confinement of the latter with respect to the exterior.

The present invention specifically relates to a process and an apparatus for the dynamic separation of the two zones and designed in such a way as to very significantly reduce the gas consumption within the zones and so as to ensure an effective dynamic separation in both directions.

Therefore the present invention proposes a process for the dynamic separation of two zones, according to which, in order to protect a first of the said zones with respect to the other, between the said two zones is formed a gas curtain having a relatively fast stream located on the side of the first zone and a relatively slow stream adjacent to the relatively fast stream on the side of the other zone, the relatively slow stream having a tongue which completely separates the two zones and is injected at a flow rate substantially equal to that induced by the face of the relatively fast stream in contact with said relatively slow stream, wherein the thus formed gas curtain also has a second relatively slow stream adjacent to the relatively fast stream on the side of the first zone, said second relatively slow stream having a tongue completely separating the two zones and being injected at a flow rate substantially equal to that induced by the face of the relatively fast stream in contact with the second relatively slow stream.

The invention also proposes an apparatus for the dynamic separation of two zones having a plurality of nozzles able to discharge a gas curtain completely separating the two zones, and suction means for the said gas curtain, the plurality of nozzles having on the side of a first of said zones to be protected from the other zone, a first nozzle able to discharge a relatively fast gas stream and, on the side of the other zone, a second nozzle adjacent to the first nozzle and able to discharge a relatively slow stream, the width of said second nozzle being at least equal to 1/6 of the length of the gas curtain, wherein the plurality of nozzles comprises, on the side of the first zone, a third nozzle adjacent to the first nozzle and able to discharge a relatively slow stream, the width of said third nozzle being at least equal to 1/6 of the length of the gas curtain.

Advantageously, the suction means comprise a suction grid placed facing the plurality of nozzles and oriented parallel thereto.

In the case where one of the zones is defined by an enclosure, means can be provided for diffusing into the said enclosure a gas flow at a rate which is then substantially below the gas flow rate which had to be injected into the prior art apparatuses.

The invention is described in greater detail hereinafter relative to a non-limitative embodiment and the attached drawings, wherein show:

FIG. 1 a sectional view very diagrammatically showing an apparatus according to the invention ensuring the dynamic separation of two zones, whereof one is defined by an enclosure.

Figure 2:
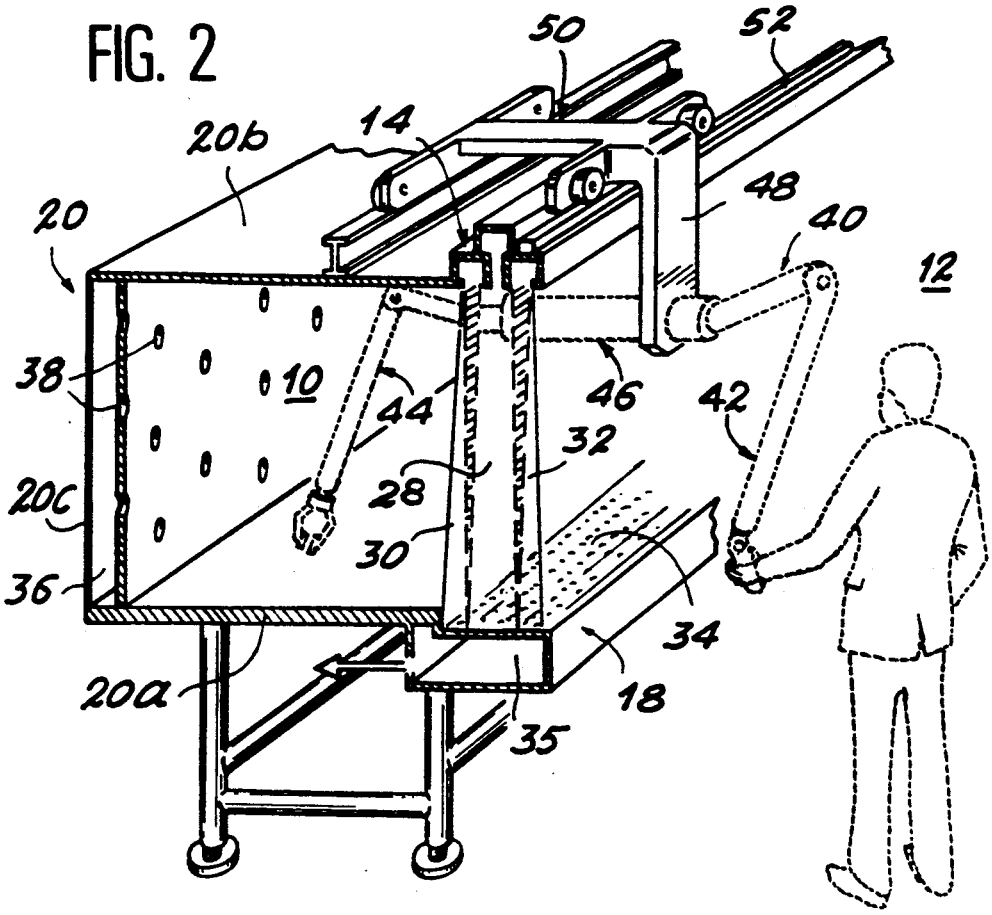

FIG. 2 a part sectional, perspective view illustrating the dynamic separation apparatus of FIG. 1 and applied to the confinement of a working zone in which very varied manipulations have to be performable.

According to the invention and as is very diagrammatically illustrated in FIGS. 1 and 2, said dynamic separation of the two zones 10 and 12 is brought about by an apparatus mainly comprising a plurality of nozzles 14 making it possible to create between the two zones 10 and 12 a gas curtain 16, as well as suction means 18 for the said gas curtain.

In the illustrated embodiment, the zone 10 is a confined zone shaped like a rectangular parallelepiped defined on all its faces by a wall 20, with the exception of its front face which is open towards the outside. In particular, FIG. 2 shows the bottom 20*a*, top 20*b* and vertical end 20*c* of the said wall 20. The front face of the zone 10 is open so as to define an access opening, whose upper edge supports over its entire length the plurality of nozzles 14, which is fixed to the top 20*b* and whose lower edge supports over its entire length the suction means 18 fixed to the bottom 20*a*.

It is readily apparent that the apparatus according to the invention can be used in numerous other cases, no matter whether this is for ensuring the dynamic confinement of a zone defined by an enclosure having one or more differently shaped openings, or for defining, within a room, a zone confined without the aid of any other material wall. This latter case more particularly applies to the protection of an operating table or bed from a circular, rectangular or similar ramp overhanging the zone in question and carrying all the nozzles.

The physical and chemical characteristics within the confined zone 10, such as the temperature, hygrometry, gas concentration, etc. can be controlled at random by known means.

As illustrated in FIG. 1, the plurality of nozzles 14 comprises, according to the invention, three juxtaposed nozzles designated respectively 22, 24 and 26. In practice, each of these nozzles is constituted by a case, e.g. having a rectangular section and which is open on the side of the opening formed in the wall 20, i.e. facing the suction means 18, e.g. in the form of a grid or grating.

The opening of the central nozzle 24 has a relatively small width (e.g. approximately 6 mm), so that the velocity of the gas stream or jet 28 leaving said nozzle 24 is relatively high (e.g. approximately 4 m/s), for a low flow rate (e.g. approximately 100 $m^3/h$). However, the nozzles 22 and 26, which are respectively placed on the side of the zone 10 and on the side of the zone 12 and which preferably have identical characteristics, have an opening with a relatively large width (e.g. approximately 200 mm), so that for an average gas injection flow rate within the nozzles (e.g. approximately 440 $m^3/h$), the gas streams 30,32 leaving the nozzles have a relatively low velocity (e.g. approximately 0.4 m/s).

According to a first essential feature of the invention, the tongues 30*a*,32*a* of the gas streams 30,32, i.e. the area of said gas streams in which the velocity vector remains identical both with regards to its modulus and with regards to its direction, have a length which is at least equal to the height of the opening in which the apparatus according to the invention ensures the dynamic separation between the zones 10 and 12. In other words, the two tongues 30*a*, 32*a* ensure a complete dynamic separation between the zones 10 and 12. In the case illustrated in FIG. 1, in which the height of the opening is defined by the distance separating the plurality of nozzles 14 from the suction means 18, the length of each of these tongues 30*a*, 32*a* is at least equal to the said distance.

In practice, in view of the fact that the length of the tongue of a gas stream is equal to approximately 6 times the width of the slot formed in the nozzle by which said gas stream is discharged, the width of the slots formed in the nozzles 22 and 26 is consequently equal to at least approximately 1/6 of the distance separating the plurality of nozzles 14 from the suction means 18. In the example in question, where the width of the slots of the nozzles 22,26 is approximately 200 mm, the height of the protected opening is consequently at the most equal to approximately 1200 mm. Thus, in the apparatus according to the intention, there is a double dynamic separation between the zones 10 and 12, ensured by each of the tongues 30*a*,32*a* of the relatively slow streams 30,32.

Bearing in mind the relatively low velocity of the gas streams 30,32, each of the streams might be inflected, e.g. under the effect of an air flow in the zones 10 and 12, if the relatively fast gas stream 28 was absent. However, the velocity of the gas stream 28 discharged by the nozzle 24 is sufficiently high to ensure that the said stream can serve as a support for each of the streams 30,32. Therefore the latter are stabilized and any risk of a break in the confinement resulting from their deformation due to a possible air flow is eliminated.

In known manner, a gas stream passing out of a nozzle has, in addition to the aforementioned tongue, whose width progressively decreases on moving away from the nozzle, a zone of full development of the stream or jet, whose width progressively increases on moving away from the nozzle and in which the gas injected by the nozzle mixes, by suction, with the surrounding gas. In this full jet development zone, the gas discharged by the nozzle is "fed" by the surrounding gas. As is readily apparent, the surrounding gas quantity which must be supplied to a developing gas stream increases with the velocity of the gas within said stream. Thus, the vacuum created by the stream is then higher and the gas quantity necessary for filling it is consequently greater.

If this observation is applied to the apparatus according to the invention, it can be seen that the relatively fast gas stream 28 from the nozzle 24 must be fed by the relatively slow gas streams 30,32 from the nozzles 22,26, because the stream 28 is located directly between the said streams 30,32. Consequently the relatively fast gas stream 28 is entirely fed by the relatively slow gas streams 30,32. In order that the latter can correctly fulfil this function, the gas flow rate from the said nozzles 22 and 26 must be regulated so as to supply the relatively fast gas stream 28 with the gas quantity necessary for its complete development. In other words, the gas flow rate injected by the nozzles 22 and 26 must be substantially equal to the rate induced by each of the faces of the relatively fast gas stream 28 respectively in contact with the relatively slow gas streams 30, 32.

In view of the fact that the gas streams 30, 32 are relatively slow, the addition of gas necessary for their full development respectively on the face of the stream 30 turned towards the zone 10 and on the face of the stream 32 turned towards the zone 12 is relatively low. Consequently if the volume of the zones 10 and 12 is sufficiently large, it would appear to be pointless to carry out any gas addition to these zones in order to compensate the gas quantity used for feeding the gas streams 30 and 32.

In the case illustrated in FIGS. 1 and 2, where one of the zones, such as 10, has a relatively small volume, it can be useful to regularly introduce into it a gas flow used for compensating that part of the gas taken by the gas stream 30. However, due to the low velocity of said gas stream, the flow rate of the addition gas flow remains very low compared with that which was necessary, in the prior art, for feeding the relatively fast gas stream when the latter is in direct contact with the atmosphere confined within the room.

The suction means 18 are advantageously constituted by a grid or grating 34 extending parallel to the plurality of nozzles 14 and in front of the latter, over its entire length and over a width taking account of the development of the streams 30 and 32. This grid 34 constitutes the upper wall of a suction chamber 35 (FIG. 2).

Between the suction chamber 35 and the plurality of nozzles 14 is placed a not shown gas circuit, which is generally closed and makes it possible to recycle the recovered gas through the grid 34 and reinject it through the plurality of nozzles 14 with a controlled flow rate, so as in particular to take account of the requirements mentioned hereinbefore. This circuit, which can be designed in a comparable manner to that described in EP-A-99 818, comprises means making it possible to suck in the gas curtain formed by the streams 28, 30 and 32 through the grid 34, means making it possible to purify said gas and means for reinjecting it into each of the nozzles of the plurality of nozzles 14 at the desired flow rate. This circuit, which can be designed in a random manner taking account of the different requirements, does not form part of the present invention.

The preceding description makes it clear that the apparatus according to the invention makes it possible to create a symmetrical gas curtain formed from three juxtaposed gas streams and ensuring on the one hand a protection of the zone 10 from the zone 12 and on the other a protection of the zone 12 from the zone 10. The first protection is ensured with respect to any gas flow tending to pass into the zone 12 the atmosphere contained in the zone 10 by the means formed by the tongue **30*a* of the relatively slow gas stream 30 and by the relatively fast gas stream 28 which stabilizes the stream 30. The protection with respect to any gas flow tending to pass into the zone 10 the atmosphere contained in the zone 12 is ensured by the tongue 32*a* of the relatively slow gas stream 32, which is stabilized by the relatively fast gas stream 28. This leads to a cross protection, which is particularly useful in numerous industrial applications, particularly when the zone 10 contains an atmosphere which must be protected from the pollution of the external atmosphere contained in the zone 12 and in which the atmosphere contained in the zone 10 could be dangerous if it reached the external atmosphere of the zone 12**.

When no obstacle traverses the three gas streams discharged by the plurality of nozzles 14, the gas curtain formed by the same consequently ensures a complete isolation of the controlled zone 10 from the external zone 12 and conversely an isolation of the external zone 12 from the controlled zone 10.

In the presence of an obstacle (such as a manipulator arm acting from the zone 12 into the zone 10) and which moves slowly, the isolation between the said two zones is maintained.

As is illustrated by FIG. 2, the rear face **20*c* of the wall 20 defining the controlled zone 10 comprises, in the example described, a double wall internally defining a gas admission chamber 36, which communicates with the zone 10 by perforations 38. The chamber 36 is connected to a not shown gas source, in such a way that the gaseous atmosphere of the zone 10 is renewed at a controlled flow rate, which is optimized as a function of the dimensions of the perforations 38, so that it does not modify the direction of the gas streams leaving the plurality of nozzles 14**.

As stated hereinbefore, the use of a plurality of nozzles 14 discharging three juxtaposed gas streams having a relatively fast intermediate stream 28 and two relatively slow lateral streams 30 and 32 makes it possible to very significantly reduce the gas quantity introduced into the zone 10 compared with the prior art apparatuses, in which the relatively fast stream was directly in contact with the atmosphere contained in the controlled zone. Thus, a flow rate of a few $m^3/h$ is adequate in the case of FIG. 2, whereas with the prior art apparatuses a rate of approximately 470 $m^3/h$ was necessary.

FIG. 2 also illustrates in exemplified manner one of the many possibilities of intervention offered by the dynamic separation apparatus according to the invention within the controlled zone 10. In this case, a master-slave telemanipulator 40 traverses the gas curtain formed by the plurality of nozzles 14, in such a way that the master arm 42 is located in the external zone 12 and the slave arm 44 in the confined zone 10. The central block 46 of said telemanipulator 40 is mounted on a support 48 connected to a carriage 50 able to travel on rails 52 fixed to the top **20*b* and extending in a direction parallel to the opening formed on the front face of the wall 20, i.e. to the plurality of nozzles 14 and the suction means 18**.

As a result of this arrangement, it is possible by means of a single telemanipulator to intervene at any point of the zone 10, no matter what its length. The central block 46, which traverses the gas streams 28, 30, 32 has the effect of intersecting or cutting the tongues **30*a*, 32*a*. However, due to the slowness of the streams 30, 32, there is no separation of the gas flowing in these two gas streams with respect to the obstacle formed by the crossing block 46. Moreover, the intermediate gas stream 28 makes it possible, as a result of its speed, to immediately discharge a large proportion of contaminants which may have diffused into the slow jets. Consequently, the dynamic separation between the zones 10 and 12** is maintained.

The presence of a supplementary gas flow in the enclosure leads to a supplementary guarantee of non-pollution of the enclosure atmosphere by pollutants from the zone 12.

Obviously, the gas curtain obtained with the aid of the dynamic separation apparatus according to the invention can be traversed by any other tools or members making it possible for an operator to intervene from the outside at a random point of zone 10. It can in fact be a lightweight gripping tool manipulated by the operator from the outside, or even the operator's arm.

The invention is not limited to the embodiment described in exemplified manner hereinbefore and covers all variants thereof. In particular, the dynamic separation obtained with the aid of the three juxtaposed gas streams can be used for isolating a given zone within a larger room without said zone being defined by any material barrier. Moreover, the arrangement of the plurality of nozzles and the suction means can be carried out in a different way, it not being necessary to place them on the horizontal edge or rim of an opening.

We claim:

1. A process for dynamically separating and protecting first and second adjacent zones from each other, comprising the steps of forming a gas curtain between said zones, providing said curtain with a relatively fast stream and first and second relatively slow streams, locating said first slow stream located between said fast stream and said first zone, locating said second slow stream located between said fast stream and said second zone, forming a tongue (30*a*, 32*a*) with each said first and second slow streams which completely separates the two zones, and injecting each said first and second slow streams at a flow rate substantially equal to that induced by faces of the relatively fast stream in contact with said slow streams.

2. Apparatus for dynamically separating and protecting first and second zones from each other, comprising discharge means adapted to discharge a gas curtain which completely separates said zones, suction means for said curtain opposite said discharge means, said discharge means including first, second, and third nozzle means, said first nozzle means comprising means for discharging a relatively fast gas stream, said second nozzle means comprising means for discharging a relatively slow gas stream between the first zone and the fast gas stream, said third nozzle means comprising means for discharging a relatively slow gas stream between the second zone and the fast gas stream, the second and third nozzle means each having a discharge opening which is at least equal to 1/6 of the length of the gas curtain between said discharge means and said suction means.

3. Apparatus according to claim 2, wherein the suction means comprise a suction grid or grating positioned facing the plurality of nozzles and oriented parallel to the latter.

4. Apparatus according to claim 2, wherein said first zone is defined by an enclosure and wherein said second nozzle means is adapted to diffuse a gas flow into said first zone at a relatively low rate, said low rate being substantially equal to a flow rate induced by a face of the relatively slow stream discharged by said second nozzle means adjacent said first zone.

* * * * *

UNITED STATES PATENT AND TRADEMARK OFFICE

CERTIFICATE OF CORRECTION

PATENT NO. : 5,145,459

DATED : September 8, 1992

INVENTOR(S) : Francois Meline, et al.

It is certified that error appears in the above-identified patent and that said Letters Patent is hereby corrected as shown below:

On the Title page, item [73] Assignee, line 1, "SGN-SocieteGeneral Pour Les" should be --SGN-Societe Generale Pour Les--.

Column 4, line 18, "area" should be --areas--.

Column 7, line 36, delete "located".

Column 8, line 1, delete "located".

Signed and Sealed this

Ninth Day of November, 1993

Bruce Lehman

*Attest:*

BRUCE LEHMAN

*Attesting Officer*

*Commissioner of Patents and Trademarks*